United States Patent [19]

Scully

[11] Patent Number: 4,580,943

[45] Date of Patent: Apr. 8, 1986

[54] TURBINE WHEEL FOR HOT GAS TURBINE ENGINE

[75] Inventor: Andrew J. Scully, Mt. Clemens, Mich.

[73] Assignee: The United States of America as represented by the Secretary of the Army, Washington, D.C.

[21] Appl. No.: 220,947

[22] Filed: Dec. 29, 1980

[51] Int. Cl.[4] ..... F01D 5/08

[52] U.S. Cl. ..... 415/116; 415/175; 415/214; 416/95; 416/195; 416/189; 416/218; 416/241 B

[58] Field of Search ..... 416/241 B, 189 R, 218, 416/95, 195, 219 R, 189; 415/116, 175, 214, 212 A

[56] References Cited

U.S. PATENT DOCUMENTS

| | | | |
|---|---|---|---|
| 1,678,065 | 7/1928 | Lamb | 415/116 |
| 1,776,832 | 9/1930 | Holzwrath | 415/116 |
| 1,829,674 | 10/1931 | Rosenlöcher | 416/90 |
| 1,947,462 | 2/1934 | Doorbar | 416/189 |
| 2,769,611 | 11/1956 | Schwarzkopf | 416/219 |
| 3,088,192 | 5/1963 | Turner | 416/219 UX |
| 3,597,102 | 8/1971 | Unsworth et al. | 415/175 X |
| 3,677,660 | 7/1972 | Taniguchi et al. | 416/189 R UX |
| 3,857,650 | 12/1974 | Cerrato | 416/189 X |
| 4,111,603 | 9/1978 | Stahl | 416/241 B X |

FOREIGN PATENT DOCUMENTS

| | | | |
|---|---|---|---|
| 1812491 | 12/1970 | Fed. Rep. of Germany | 416/189 |
| 2069065 | 8/1981 | United Kingdom | 416/241 B |

OTHER PUBLICATIONS

*"Thermodynamics" 2 ed, J. P. Holman, p. 555 Steamtables.*

*Primary Examiner*—Harvey C. Hornsby
*Assistant Examiner*—Frankie L. Stinson
*Attorney, Agent, or Firm*—Peter A. Taucher; John E. McRae; Robert P. Gibson

[57] ABSTRACT

A turbine wheel for a hot gas turbine engine operable at relatively high temperatures, e.g. above 2,000° F., and high velocities, e.g. above 30,000 r.p.m. The blades are formed of temperature-resistant ceramic material. A special annular band of high tensile strength material is affixed to tip areas of the blades for translating centrifugal forces into compressive loadings on the blades. To compensate for differential thermal expansion of the band relative to the blades a localized cooling system is provided for selectively cooling the annular band without cooling the blades.

6 Claims, 1 Drawing Figure

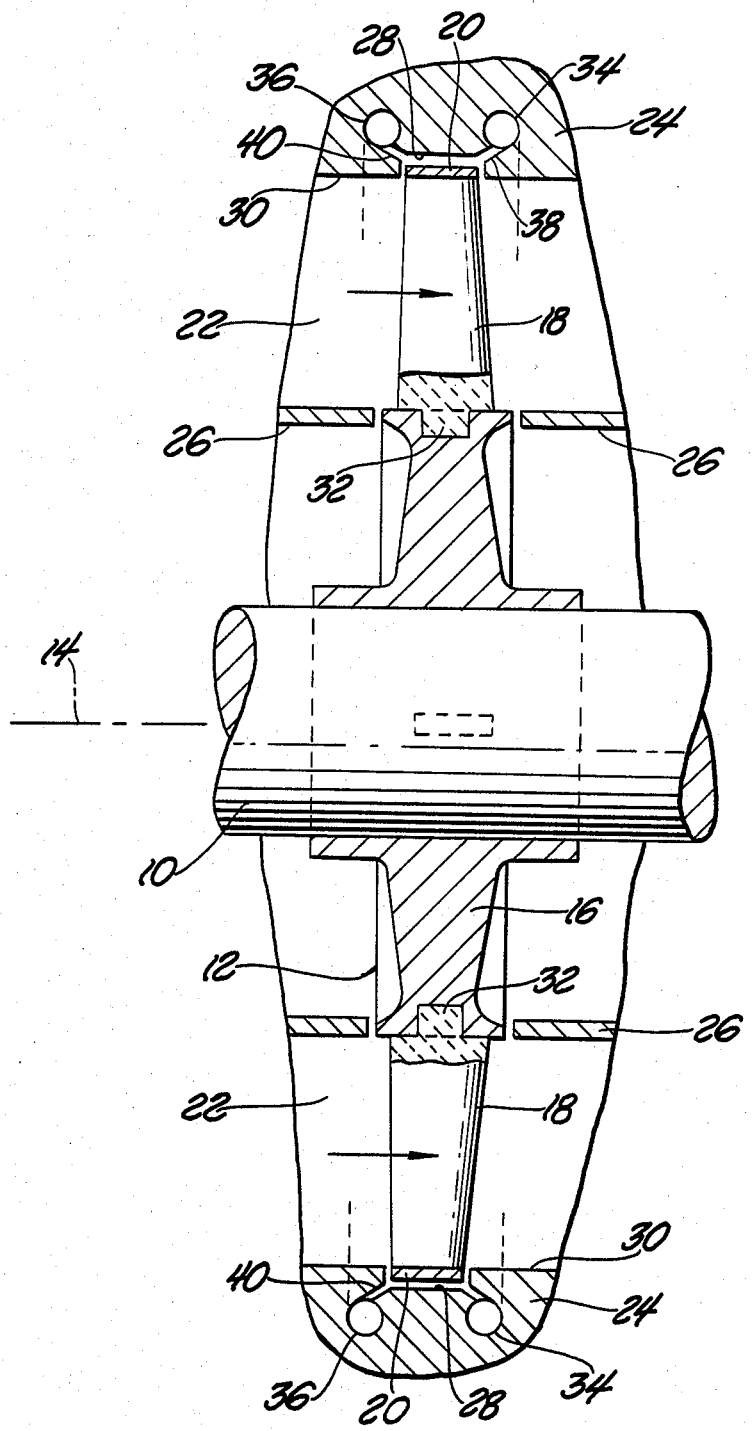
28
20
36
34
24
40
30
38
22
18
26
26
32
14
10
16
12
32
26
22
18
30
40
24
36
20
28
34

TURBINE WHEEL FOR HOT GAS TURBINE ENGINE

The invention described herein may be manufactured, used, and licensed by or for the Government for governmental purposes without payment to me of any royalty thereon.

BACKGROUND AND SUMMARY

This invention relates to automotive gas turbine engines, as shown for example in U.S. Pat. No. 4,038,815, issued on Aug. 2, 1977 to A. M. Heitmann et al. My invention relates especially to an improved turbine wheel construction for such engines, and to arrangements for selectively cooling portions of the turbine wheels to minimize thermal expansion effects that would tend to cause premature turbine wheel failure. I propose to form the turbine blades out of a temperature-resistant ceramic refractory material having high compressive strength but relatively low tensile strength; to prevent explosive failures I confine the blades within a surrounding annular band formed of stainless steel or other high tensile strength material. I avoid undesired expansion of the high tensile strength band relative to the refractory blades by selectively cooling the band outer surface.

My invention has for its object the provision of a hot gas turbine wheel having performance capabilities at temperatures in excess of 2,000° F. and relatively high velocities, e.g. in excess of 30,000 r.p.m.

In the drawings the single FIGURE is a sectional view taken through an axial flow turbine embodying my invention.

The turbine comprises a rotary shaft 10 having a turbine rotor 12 secured thereon for rotation around shaft axis 14. The rotor comprises a steel hub 16, a series of radial blades 18 formed of ceramic refractory material, and an annular reinforcement band 20 formed of steel or other high tensile strength material. The band may be secured to the blades by thermal shrink procedures. In service the band confines the blades against undesired fracture and explosion-like failure due to centrifugal loadings associated with high rotor speeds. The hot gases, at temperatures in a range between 2,000° F. and 2,500° F., are directed from a combustor, not shown, through an annular axial flow passage 22 to impinge on the rotor blades 18, thereby producing high speed rotation of the rotor, e.g. in excess of 30,000 r.p.m.

Passage 22 is defined by an outer stationary annular wall 24 and an inner stationary annular wall 26. An annular recess 28 in wall 24 is sized to surround the outer surface areas of band 20, especially the leading edge of the band, the outer side surface of the band, and the trailing edge of the band. Passage surface 30 defined by wall 24 forms a continuation of the inner surface of band 20 so that the band offers minimal resistance to high velocity flow of combustion gases through passage 22 and blades 18.

Blades 18 are formed of a ceramic refractory material having relatively high compressive strength but relatively low tensile strength, e.g. silicon carbide, silicon nitride, boron carbide or alumina. Under conventional practice the blades are connected to the central hub by means of fir tree or dovetail cross sectioned root members mechanically locked within mating sockets in the hub; however, this type of blade securement places the blade under very high tensile loadings, for which the refractory blade material is not especially suited. In the illustrated embodiment of my invention the root portions 32 of the individual blades are straight-sided spade elements formed integrally with the blades and having non-locking snug fits in mating sockets formed in the hub periphery. This arrangement minimizes tensile loadings that would otherwise exist on the root portions of the blades.

In my invention centrifugal forces are resisted by the annular reinforcement band 20 that is formed of a high tensile strength material, such as stainless steel or graphite fibers. The high tensile strength band 20 would in most cases have a higher co-efficient of thermal expansion than the ceramic refractory material for blade 18. To prevent the band from exhibiting greater radial thermal expansion than the blade, I selectively cool the band without cooling the blades. The band will preferably be cooled to a significantly lower temperature than the blades, e.g. a band temperature of 1,400° F. and a blade temperature of 2,200° F. In the illustrated arrangement an air-jet cooling system comprises an annular inlet plenum 34 adapted to receive relatively cool air from the compressor discharge, not shown, and an annular outlet plenum 36 adapted to discharge air to a low pressure area, such as the compressor inlet or the turbine engine outlet. Recess 28 serves as a coolant space. Each plenum 34 and 36 is connected to the coolant space by means of a number of circumferentially spaced ports or jets, identified in the drawings by numerals 38 and 40. Coolant flow is from plenum 34 through jets 38 into coolant space 28, then out through jets 40 to plenum 36. As the relatively cool air flows across the outer surface of imperforate band 20 it cools the band to a relatively low temperature. The clearance between the outer surface of band 20 and the surface of recess 28 is preferably much greater than the clearances at the leading and trailing edges of band 20, thereby promoting desired coolant flow along the outer surface of the imperforate band.

Thermal conditions in passage 20 tend to expand band 20 in the circumferential direction and blades 18 in the radial direction. The different directional factors, taken with the differences in thermal coefficients for the band and blade materials, tends to cause a loosening of the band on the blade tips. By selectively cooling the band, without cooling the blades, the band is caused to maintain its pressure engagement with the blades, thereby converting centrifugal force on the rotor into compressive loadings on the blades. This is in contrast to the action in conventional turbine wheel systems not equipped with the blade-confining band; in conventional arrangements the centrifugal forces place the blade material in tension. Ceramic refractory blade materials exhibit relatively high compressive strengths but low tensile strengths. My proposed blade-band arrangement loads the blades in the optimum manner to permit higher wheel speeds without explosive-type failure.

Coolant flow through space 28 may be controlled by a non-illustrated thermostatic valve or other control system so that thermal expansion of band 20 in the radial direction is approximately the same as that of the blades, the aim being to prevent looseness in the band-blade tip engagement or excessive radial force of the blade on the band due to thermal effects. The band will absorb the radial loadings due to centrifugal force, thus preventing turbine wheel failure due to centrifugal effects.

I wish it to be understood that I do not desire to be limited to the exact details of construction shown and described for obvious modifications will occur to a person skilled in the art.

I claim:

1. In a gas turbine engine: the improvement comprising an axial flow turbine designed to receive pressurized gases at temperatures above 2000° F.; said turbine comprising a rotor and annular flow passage structure; said rotor including a central hub, individual separately-formed blades extending radially outwardly from the hub periphery within the flow passage, and an endless annular reinforcement band affixed to outer tip areas of the blades; said blades being formed of ceramic refractory material having high compressive strength but relatively low tensile strength; said endless annular band being formed of a high tensile stength material, whereby the band converts centrifugal force on the rotor into compressive loadings on the blades; the band material having a higher coefficient of thermal expansion than the blade-material; the aforementioned passage structure having an annular recess therein sized to surround outer surface areas of the aforementioned band so that the band offers minimal resistance to flow of high temperature gases through the blade area; the outer surface of the band being spaced radially inwardly from the recess surface to define an annular band coolant space; and means for circulating relatively cool gas through the coolant space to maintain the band at a significantly lower temperature than the blades whereby thermal expansion of the band in the radial direction is reduced to a level approximating that of the blades; each blade being connected to the central hub by means of a radial socket formed in the hub periphery, and a blade root section (32) extending into the associated socket; each blade root section (32) having a non-locking snug fit in the associated socket whereby centrifugal force puts the blade material under compression rather than tension.

2. The improvement of claim 1 wherein each blade root section (32) is a straight-sided element having a lesser cross-sectional dimension than the aerodynamic portion of the blade, whereby the aerodynamic portion of each blade abuts against the hub peripheral surface.

3. The improvement of claim 1 wherein the annular reinforcement band is affixed to the blades by means of a shrink fit connection.

4. The improvement of claim 1: the coolant circulating means comprising an annular inlet plenum (34) and an annular outlet plenum (36) concentric with the annular recess, and circumferentially-spaced jets interconnecting each plenum with the annular recess so the coolant flows from the inlet plenum through the recess and into the outlet plenum.

5. The improvement of claim 4: the clearance between the band outer surface and the opposing surface (28) of the recess being much greater than the clearance at the band leading edge, the clearance between the band outer surface and the opposing surface (28) of the recess being much greater than the clearance at the band trailing edge, thereby promoting coolant flow along the outer surface of the band.

6. The improvement of claim 5: the plane of the band inner surface forming a planar continuation of the adjacent passage structure surfaces (30).

* * * * *